United States Patent [19]

King

[11] Patent Number: 4,560,073

[45] Date of Patent: Dec. 24, 1985

[54] RACK WITH DETACHABLE DIVIDERS

[75] Inventor: Clarence J. King, Ludington, Mich.

[73] Assignee: Straits Steel & Wire Co., Ludington, Mich.

[21] Appl. No.: 554,892

[22] Filed: Nov. 25, 1983

[51] Int. Cl.[4] ..... A47F 5/01

[52] U.S. Cl. ..... 211/184; 211/11; 211/43; 211/181

[58] Field of Search ..... 211/181, 10, 11, 184, 211/50, 43, 40, 42; 108/60, 61

[56] References Cited

U.S. PATENT DOCUMENTS

| | | | |
|---|---|---|---|
| 999,974 | 8/1911 | Fauth | 211/184 X |
| 1,277,827 | 9/1918 | Barber | 211/184 X |
| 2,889,054 | 6/1959 | Wheeler | 211/181 X |
| 3,241,683 | 3/1966 | Blodee | 211/184 X |
| 4,023,682 | 5/1977 | Niece | 211/43 X |
| 4,410,093 | 10/1983 | Chiariello et al. | 211/184 X |
| 4,437,572 | 3/1984 | Hoffman | 211/184 X |

FOREIGN PATENT DOCUMENTS

| | | | |
|---|---|---|---|
| 912044 | 12/1962 | United Kingdom | 211/184 |

*Primary Examiner*—Robert W. Gibson, Jr.

*Attorney, Agent, or Firm*—Price, Heneveld, Huizenga & Cooper

[57] ABSTRACT

A rack having a base which base includes a pair of elongated side rails and a plurality of cross members rigidly secured thereto at equally spaced intervals. A pair of spaced anchor rails are secured to the tops of said cross members which anchor rails are parallel to and spaced from said side rails. A plurality of upstanding article supports each having a pair of legs of a length greater than the spacing between the cross members are seated on the cross members and spaced apart substantially the same distance as said anchor rails. The support members have hook means on the legs extending beneath said anchor rails for holding the article supports against vertical and pivotal movement relative to the base and detent means on one of the hook means detachably clamps one of said anchor rails between it and the leg to which it is attached for holding the article support against lateral movement relative to said base. At least the lower portions of the article supports are resilient to permit the legs to be sufficiently separated to effect attachment and detachment of the articles from the anchor rails.

18 Claims, 7 Drawing Figures

RACK WITH DETACHABLE DIVIDERS

FIELD OF THE INVENTION

This invention relates to storage racks of the type used in offices and the like. It is particularly suitable for desk or table top use for supporting paper items such as brochures, reports, folders and the like.

BACKGROUND OF THE INVENTION

Numerous racks have been developed with supports or dividers for holding files and similar items in a readily visible and readily accessible position. Normally these racks consist of a base and a plurality of partitions, dividers or supports. The partitions are normally inclined at an angle so that the papers or folders are tipped slightly both to cause them to shift toward one end of each of the storage slots and also to increase visibility of the ends or tops of the folders to facilitate identification. One of the problems with these racks has been the fact that the location and spacing of the dividers or supports is permanently fixed at the time of manufacture and cannot be adjusted at the point of use. Therefore, a rack having a certain spacing between the supports or dividers cannot be utilized for items which are too thick or bulky to fit in the slot between a pair of the supports. The reverse is also true in cases where the slots are too wide to properly support the individual items. In a few cases the racks have been made such that there is a limited degree of adjustability. However, such racks have been complicated and expensive as well as cumbersome both to use and to adjust.

BRIEF DESCRIPTION OF THE INVENTION

This invention provides a rack having a rigid base. The base itself has no article supports or dividers. The article supports and dividers are separate components which are detachably secured to the base in such a manner that simply by slightly deflecting the foot or leg portion of the divider, it can be engaged with the base or detached from the base. Thus, only as many dividers are used as are necessary and the spacing between the dividers can be adjusted at the point of use in accordance with the circumstances of use. Further, it is also possible to arrange the dividers so that the rack has slots of various widths to accommodate items of different sizes.

DESCRIPTION OF THE PREFERRED EMBODIMENT

Figure 1:
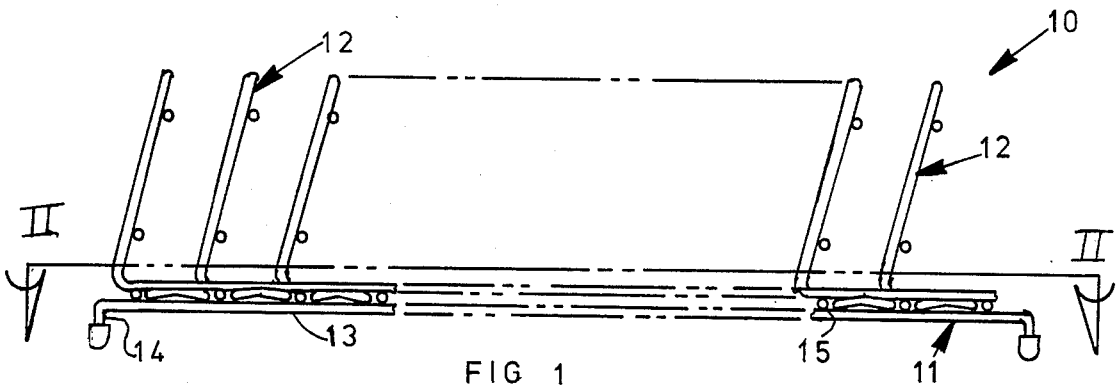
FIG. 1 is a broken side elevation view of a rack incorporating the invention.

Referring to FIG. 1, the numeral 10 indicates a rack having a base 11 and a plurality of article supports 12. The base of the preferred embodiment has a frame including a pair of support members 13 extending the length of the rack which, at each end, have a downwardly extending leg 14 to support the base. The support members 13 are rigidly tied together at equally spaced intervals by cross members 15. The cross members 15 are preferably welded to the support members 13. The spacing between the cross members 15 is dependent upon the size of the rack and the maximum number of article supports 12 which are to be utilized with the rack. For example, the spacing between the cross members 15 can be two inches. This, however, could be increased to three inches or reduced to one inch, for example. It is important that the cross members 15 be parallel to each other and normal to the support members 13.

Figure 3:
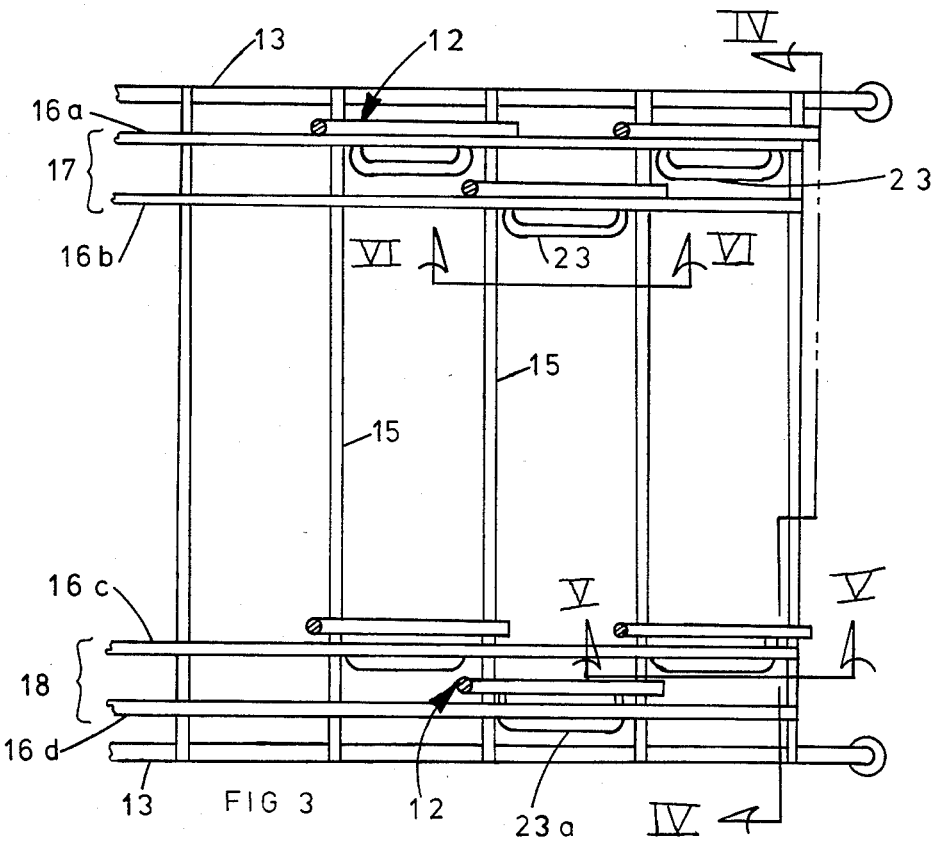
FIG. 3 is an enlarged fragmentary top plan view of the base with three of the dividers assembled to the base.

Paralleling each of the support members 13 but spaced inwardly from them are anchor rails **16*a*, 16*b*, 16*c* and 16*d* structurally arranged in pairs 17 and 18 (FIG. 3). As will be best seen in FIG. 3, the anchor rails 16*a* are parallel to and adjacent one of the support members 13 and the other pair of anchor rails 16*b* is parallel to and adjacent the other support member. Functionally, the anchor rails are arranged in pairs consisting of rails 16*a* and 16*c* forming one pair and rails 16*b* and 16*d* forming the other pair. The spacing between the anchor rails of each pair is identical. This is important to the construction of the rack and to its function. The anchor rails are rigidly secured, as by welding, on the tops of all of the cross members 15. Preferably, the support members, cross members and anchor rails are all formed of wire rod with the thickness of the rods being determined by the load they are expected to support. Thus, the support members 13** are preferably of a substantially larger size rod than either the cross members or the anchor rails.

Figure 4:
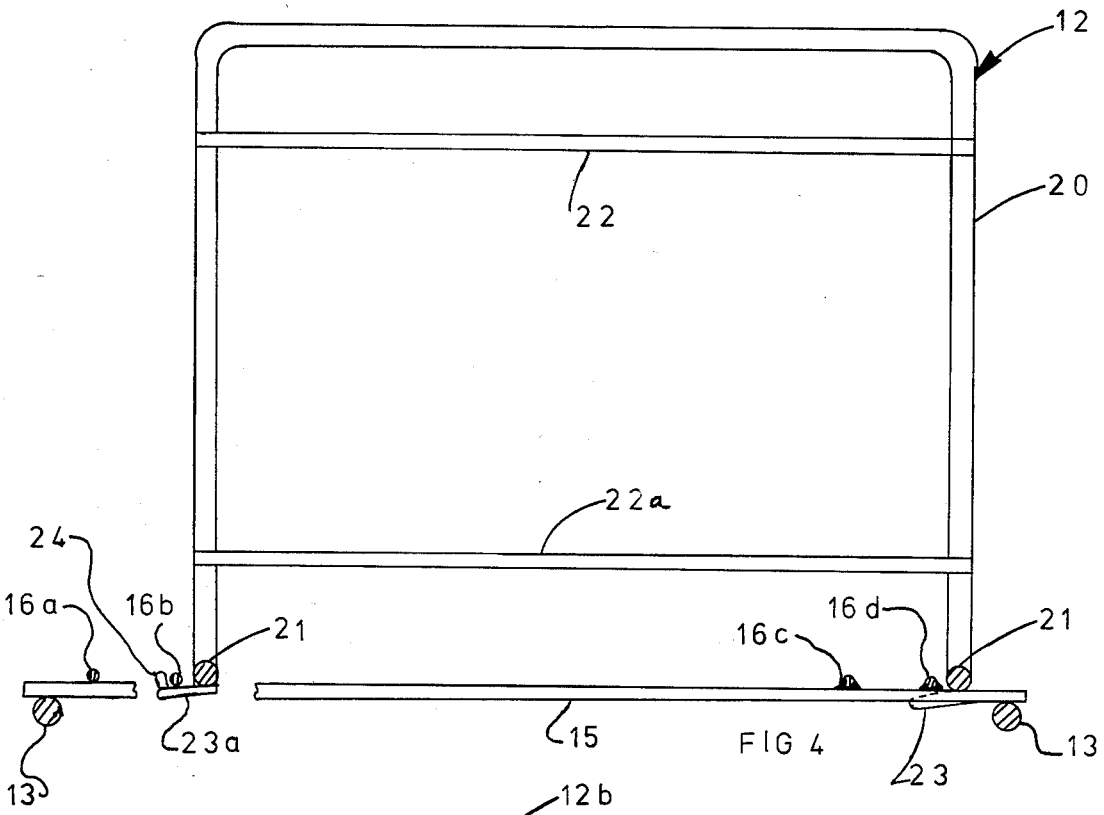
FIG. 4 is a sectional view taken along the plane IV—IV of FIG. 3 illustrating the cross member with a portion of the base cross member broken out for clarity.
Figure 7:
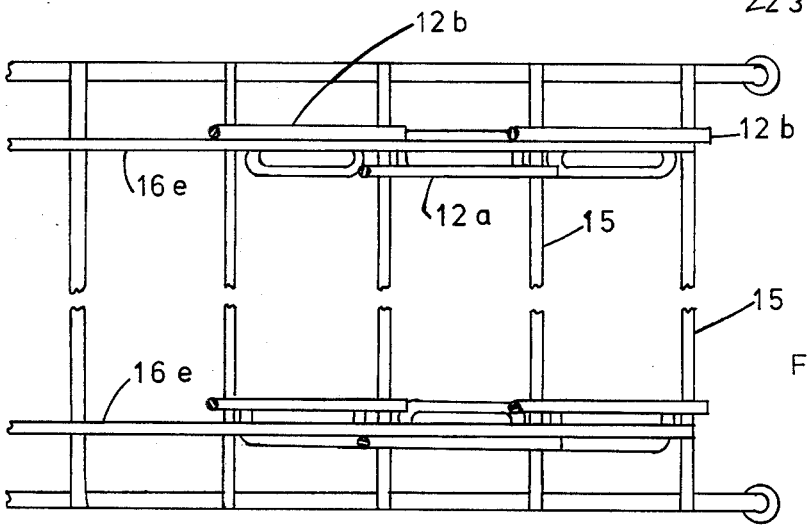
FIG. 7 is a fragmentary top plan view similar to FIG. 3 illustrating a modification of the invention.
Figure 5:
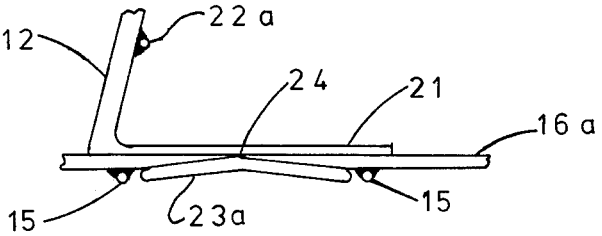
FIG. 5 is a fragmentary sectional view taken along the plane V—V of FIG. 3.

All the article supports 12 are identical. In the illustrated embodiment, each article support consists of an inverted U-shaped body 20 having a pair of elongated parallel feet or legs 21 which form the base of the support. Thus, the supports, when viewed from one end of the rack appear to be of an inverted U-shape (FIG. 4) and when viewed from the side of the rack to be generally L-shaped (FIG. 5). The length of the feet 21 is greater than the spacing between a pair of adjacent cross members 15. (FIG. 5). The feet are flat to seat on the top of the cross members 15. The spacing between the feet 21 is slightly greater than the spacing between a functional pair of the anchor rails such as the anchor rails **16*a* and 16*c* or anchor rails 16*b* and 16*d*. In the preferred embodiment, the spacing between the feet is the same as the overall width of the article support 12 but this is not necessarily true as the article support above the feet could be narrower or wider than the spacing between the feet, depending on the particular construction desired. The sides of the article support are interconnected by reinforcing rods 22, the number of which can vary, depending on the design and the amount of support needed to hold the articles. In the preferred embodiment, a pair of the reinforcing rods are utilized. The lower reinforcing rod 22 is spaced well above the feet 21. This is important because, in practicing the invention, it is necessary that the spacing of the feet be varied to permit the article supports 12** to be attached to and detached from the base as will be explained subsequently.

Secured to one of the feet is a hook 23 and to the other a hook 23*a*. Each hook consists of a U-shaped piece with the ends of its legs welded to the bottom of the feet. The length of the hooks is less than the spacing between a pair of adjacent cross members 15 so they may be passed between them. Both of the hooks extend in the same direction from their respective feet and both are inclined downwardly away from the feet to which they are attached. The hooks 23*a* on each article support is crimped slightly upwardly at the center to form a detent 24.

Figure 6:
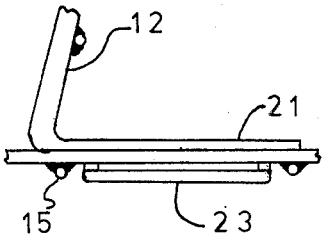
FIG. 6. is a fragmentary sectional view taken along the plane VI—VI of FIG. 3.

To secure one of the article supports to the rack the feet of the article support are seated on a pair of the cross members 15 and then the support member is pushed laterally of the base in the direction of the crimped hook 23*a* with sufficient pressure that the crimp will be forced to deflect and pass under one of the anchor rails. At the same time the hook 23 on the other foot of the same support member will be pushed under the anchor rail of the functional pair of anchor rails such as 16*b* and 16*d* (FIGS. 5 and 6). When the crimp of hook 23*a* passes beyond its anchor rail, it will resiliently snap upwardly into position. At this point, as is clear from FIG. 4, the inclination of the other hook 23 will act as a wedge or cam against the lower face of the other rail of the functional pair of anchor rails thus urging the article support in a direction to pull the crimp or detent 24 firmly against the anchor rail. Thus, the article supports will both be forced down firmly against the cross members 15 and will be firmly held against lateral motion. The long feet, spanning a pair of the cross members 15 provides rigid and position support against rocking of the supports lengthwise of the rack. This provides a stable and positive attachment of the article support to the base and thus a firm and positive support for articles placed on the rack.

To remove one of the article supports, it is necessary to deflect or spring the foot of the support with the non-crimped or plain hook 23 sufficiently that it disengages from the anchor rail. This frees the article support to be pivoted upwardly to disengage the hook 23*a* from its rail. It will be recognized that for this purpose it is necessary that the article support be fabricated from a resilient material. A particularly suitable material is steel wire or rod. It is for this purpose also that the lower reinforcing rod 22*a* be spaced well above the feet 21 so that the feet may be spread slightly to permit both attachment and release.

Figure 2:
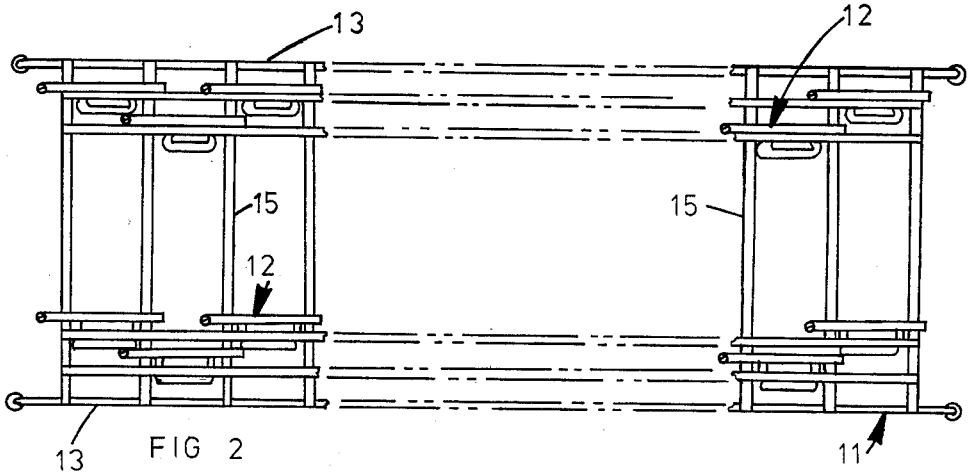
FIG. 2 is a sectional view of the rack taken along the plane II—II of FIG. 1.

It will be observed from FIGS. 1, 2 and 3 that each article support spans the distance between two adjacent cross members 15. Thus the number of individual article supports is governed by the number of available cross members. By increasing or decreasing the spacing of the cross members, the maximum number of article supports which a rack can utilize can be increased or decreased. In the preferred construction, the utilization of two parallel functional pairs of anchor rails permits a support member to be mounted between each pair of cross members because the arrangement permits alternate support members to be offset laterally of the base and thus there is no conflict arising from the fact that adjacent article supports have to utilize the same cross members for support. This arrangement permits all of the article supports to be identical, eliminating the necessity for the hooks 23 and 23*a* to extend to the right on one set of article members and to the left on alternate supports. FIG. 6 illustrates the fact that if support members are made with left and right hook arrangements, a single pair of anchor rails 16*e* can be utilized with article supports 12*a* having righthand extending hooks alternated between support members 12*b* having left-hand extending hooks. In this case, alternate support members are attached by movement in one direction and the others in the opposite direction rather than, as in the preferred embodiment, where they are all secured and removed in the same direction.

It will be recognized that the construction of the support members or dividers can be modified extensively for either functional or aesthetic purposes so long as the structural features previously discussed which control functionality are retained. The support members could be molded of plastic provided the design provided the requisite strength and resistance to deflection under loading while providing the required resilience to permit mounting and dismounting.

Having described a preferred embodiment of my invention, it will be recognized that various modifications can be made without departing from the principles. Such modifications are to be considered included in the hereinafter appended claims, unless these claims, by their language, expressly state otherwise.

We claim:

1. A rack having a frame including a pair of parallel anchor rails rigidly interconnected by a pair of parallel cross members; an article support having a pair of elongated parallel feet each foot being seated on both of said cross members, said feet being spaced the same distance as said rails and being seated adjacent said rails; a hook element on each of said feet extending beneath the adjacent rail for holding said article support against displacement from said frame in a vertical direction; detent means on one of said hook elements engaging the side of the adjacent rail opposite from the foot and detachably clamping the article support to the rail against movement parallel to said cross members.

2. A rack as described in claim 1 wherein said article support is sufficiently resilient to permit said feet to be separated enough that the other of said hook elements can be disengaged from the adjacent rail.

3. A rack as described in claim 2 wherein said frame includes support means to support said cross members.

4. A rack as described in claim 2 wherein said anchor rails are elongated and a plurality of cross members are provided; a plurality of said article supports being provided, adjacent article supports each having an end seated on a common cross member.

5. A rack as described in claim 2 wherein said anchor rails are elongated and a plurality of cross members are provided; a plurality of article supports being provided, one seated on each of the alternate pairs of said cross members; a second pair of said anchor rails parallel to and spaced from said first anchor rails; a second plurality of said article supports, each seated on one cross member of each adjacent alternate cross member pair, said second article supports having hook elements engaging beneath the rails of said second pair, one of said elements having detent means for detachably clamping the second article supports to one of the rails of the second pair.

6. A rack as described in claim 5 wherein said frame includes support members secured to and supporting said cross members.

7. A rack as described in claim 6 wherein said cross members project outwardly beyond said anchor rails and said support members are rods rigidly secured to said cross members.

8. A rack as described in claim 6 wherein said support members have depending legs.

9. A rack as described in claim 2 wherein said detent is an upwardly extending crimp in said hook element substantially midway between its ends.

10. A rack as described in claim 2 wherein said hook elements are U-shaped members, the ends of the members being welded to the lower surface of said feet.

11. A rack as described in claim 10 wherein said hook elements are inclined downwardly away from said feet.

12. A rack as described in claim 11 wherein said detent is an upwardly extending crimp in said hook element substantially midway between the ends thereof.

13. A rack as described in claim 12 wherein said crimp has a height of approximately half the thickness of one of said anchor rails.

14. A rack having a frame including a pair of parallel anchor rails and a plurality of parallel cross members, said cross members being equally spaced, rigidly secured to the bottom of and extending outwardly beyond said anchor rails; a plurality of article supports each having a pair of elongated parallel feet each foot being seated on a pair of adjacent cross members, said feet being spaced the same distance as said rails and being seated adjacent said rails; a hook element on each of said feet, said hook elements both projecting laterally and in the same direction beneath the adjacent rail for holding said article support against displacement from said frame in a vertical direction; detent means on one element of each article support engaging the adjacent rail and detachably clamping the article support to the rail against movement parallel to said cross members.

15. A rack having a frame including a pair of parallel anchor rails rigidly interconnected by a pair of parallel cross members; an article support having a pair of elongated parallel feet each seated on both of said cross members, said feet being spaced the same distance as said rails and being seated adjacent said rails; a hook element on each of said feet extending beneath the adjacent rail; detent means on one of said hook elements engaging the adjacent rail and attachably clamping the article support to the rail against movement parallel to said cross members.

16. A rack as described in claim 15 wherein the hook on the other of said feet slopes downwardly to form a camming surface engaging beneath the adjacent anchor rail and urge the detent of the other hook tightly against its adjacent anchor rail.

17. A rack as described in claim 16 wherein both of the hooks slope downwardly to form camming surfaces engaging beneath their adjacent rails.

18. A rack as described in claim 17 wherein the hooks are welded to the bottoms of the legs of said article supports.

* * * * *